US006988724B2

(12) United States Patent
Hirai

(10) Patent No.: US 6,988,724 B2
(45) Date of Patent: Jan. 24, 2006

(54) SHEET-FED PRINTING APPARATUS

(75) Inventor: Keisuke Hirai, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 137 days.

(21) Appl. No.: 10/369,509

(22) Filed: Feb. 21, 2003

(65) Prior Publication Data

US 2003/0160383 A1 Aug. 28, 2003

(30) Foreign Application Priority Data

Feb. 27, 2002 (JP) ..... P2002-052043

(51) Int. Cl.
*B65H 29/04* (2006.01)

(52) U.S. Cl. ..... 271/204; 271/298; 271/200; 271/299

(58) Field of Classification Search ..... 271/300, 271/299, 298, 204

See application file for complete search history.

(56) References Cited

U.S. PATENT DOCUMENTS

| | | | | |
|---|---|---|---|---|
| 5,377,587 | A | 1/1995 | Kobler | |
| 5,649,483 | A * | 7/1997 | Mack et al. | 101/232 |
| 6,505,828 | B2 * | 1/2003 | Seitz et al. | 271/204 |
| 6,543,764 | B1 * | 4/2003 | Mallok | 271/183 |
| 6,641,133 | B2 * | 11/2003 | Mutschall et al. | 271/204 |
| 6,659,453 | B2 * | 12/2003 | Kelm et al. | 271/183 |

FOREIGN PATENT DOCUMENTS

| | | |
|---|---|---|
| JP | 6-64351 | 7/1994 |
| JP | 6-219638 | 8/1994 |
| JP | 9-156813 | 6/1997 |
| JP | 10-87145 | 4/1998 |
| JP | 10-95157 | 4/1998 |

* cited by examiner

*Primary Examiner*—Donald P. Walsh
*Assistant Examiner*—Kaitlin Joerger
(74) *Attorney, Agent, or Firm*—McDermott Will & Emery LLP

(57) ABSTRACT

A sheet-fed printing apparatus includes a delivery section covered with a discharge section cover formed with an opening sized to allow a printed sheet to pass through. Successive printed sheets released from a chain delivery collide against a pair of first sheet-trapping elements in a closed position, and are stacked on a delivery table, with the leading edges of the printed sheets aligned with each other. If a printed sample is needed, an operator opens the first sheet-trapping elements to an open position. In synchronism with the first sheet-trapping elements, a pair of second sheet-trapping elements move to a closed position. A subsequent printed sheet passes through the opening, and stops on the second sheet-trapping elements. Thus, the printed sheet is stopped, with the leading edge thereof projecting outwardly of the sheet-fed printing apparatus. In this state, the operator can take out the printed sample without opening the delivery section cover.

6 Claims, 7 Drawing Sheets

SHEET-FED PRINTING APPARATUS

BACKGROUND OF THE INVENTION

1. Field of the Invention

The present invention relates to a sheet-fed printing apparatus for printing on sheets of printing paper and, more particularly, to a delivery section of the sheet-fed printing apparatus.

2. Description of the Background Art

A sheet-fed printing apparatus for printing on sheets of printing paper comprises a delivery section (or a paper discharge section) for receiving a stack of printed sheets. FIG. 7 is a partial sectional view of a delivery section 110*d* and its surrounding parts in a conventional sheet-fed printing apparatus 110. The delivery section 110*d* comprises a delivery table 102 for placing thereon a printed sheet pa discharged from a chain delivery 101 for transporting printed sheets. The printed sheet pa gripped by a gripper 103 carried around by the chain delivery 101 is released (or dropped) from over the delivery table 102. At this time, the leading edge of the printed sheet pa is hit against a sheet-trapping element 104, whereby the printed sheet pa falls upon the delivery table 102. In this manner, such printed sheets pa are successively stacked in a fixed position, and are referred to as stacked printed sheets ps The delivery table 102 is provided with a vertical movement element 105 for moving the delivery table 102 gradually downwardly each time the number of stacked printed sheets ps increases. This is to provide a constantly fixed distance (or vertical spacing) between the printed sheet pa and the delivery table 102 or the stacked printed sheets ps when the printed sheet pa is discharged.

An operator of the sheet-fed printing apparatus 110 is required to take printed samples out of the stacked printed sheets ps during the printing operation. Since the judgment as to whether or not printed sheets are acceptable and the adjustment of the amount of ink supply are made based on a check of the printed samples, the operator must take out printed samples at suitable sampling intervals while the sheet-fed printing apparatus 110 is in operation.

To this end, the sheet-trapping element 104 in the conventional sheet-fed printing apparatus 110 is capable of an opening movement from a closed position 104*a* indicated by the dotted lines to an open position 104*b* indicated by the solid lines. In synchronism with the opening movement of the sheet-trapping element 104, a temporary sheet-receiving element 106 pivots from an inoperative position not shown to an operative position shown in FIG. 7. Then, the printed sheet pa is discharged, with the leading edge thereof lifted up by the temporary sheet-receiving element 106. A printed sheet pb indicated by a dotted line in FIG. 7 is shown in such a lifted position.

Thus, the operator can pick one or some sheets out of the previously stacked printed sheets ps under the printed sheet pa lifted by the temporary sheet-receiving element 106. After the printed samples are taken in this manner, the sheet-trapping element 104 is returned to the closed position 104*a* indicated by the dotted lines, and the temporary sheet-receiving element 106 accordingly returns to its inoperative position not shown. Then, the printed sheet pb received in the temporary sheet-receiving element 106 is discharged onto the delivery table 102, and is additionally stacked on the previously stacked printed sheets ps.

With the above-mentioned arrangement, the operator can manually take out the printed samples with ease in principle.

It is, however, actually difficult for the operator to take out the printed samples quickly from the sheet-fed printing apparatus 110 in high-speed operation. Additionally, the delivery section 110*d* is often provided with a cover thereon so that the operator cannot easily gain access to movable parts of the delivery section 110*d*. As an example, the delivery section 110*d* may be an interlocked cover mounted thereon and is adapted to prevent the sheet-fed printing apparatus 110 from operating when the cover is open. In such a case, the operator cannot take out the printed samples during the printing operation, as discussed above.

SUMMARY OF THE INVENTION

The present invention is intended for a sheet-fed printing apparatus for printing on sheets of printing paper and, more particularly, for a mechanism for discharging printed sheets.

According to the present invention, the sheet-fed printing apparatus comprises: a) a delivery section capable of receiving a stack of printed sheets; b) a transport element for transporting a printed sheet to a release position to drop the printed sheet in the release position; c) shielding element for shielding the delivery section and the transport element from an external environment of the sheet-fed printing apparatus, the shielding element having an opening permitting the printed sheet to pass through; and d) a printed sheet discharge element capable of discharging at least a portion of the printed sheet dropped in the release position out of the sheet-fed printing apparatus through the opening.

Preferably, the shielding element comprises a first shielding element openable and closable for shielding the delivery section from the external environment of the sheet-fed printing apparatus, and a second shielding element for shielding at least the transport element from the external environment of the sheet-fed printing apparatus; and the printed sheet discharge element is capable of discharging at least the portion of the printed sheet out of the sheet-fed printing apparatus through the opening when the first shielding element is closed.

This allows an operator to obtain the printed sheet partially discharged by the printing sheet discharge element as a printed sample without the need to open the first shielding element to gain direct access to the delivery section while the first shielding element is closed and the sheet-fed printing apparatus is in operation.

Preferably, the release position includes a first release position and a second release position; the transport element is capable of selectively dropping the printed sheet in the first release position; and the printed sheet is forcedly dropped in the second release position when the printed sheet is not dropped in the first release position.

This provides different destinations to which the printed sheet is discharged, depending upon whether or not a printed sample is needed. If the printed sample is needed, the operator can easily obtain the printed sample without the need to gain direct access to the delivery section.

It is therefore an object of the present invention to provide a sheet-fed printing apparatus which allows an operator to obtain a printed sample easily even when the sheet-fed printing apparatus is in operation.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
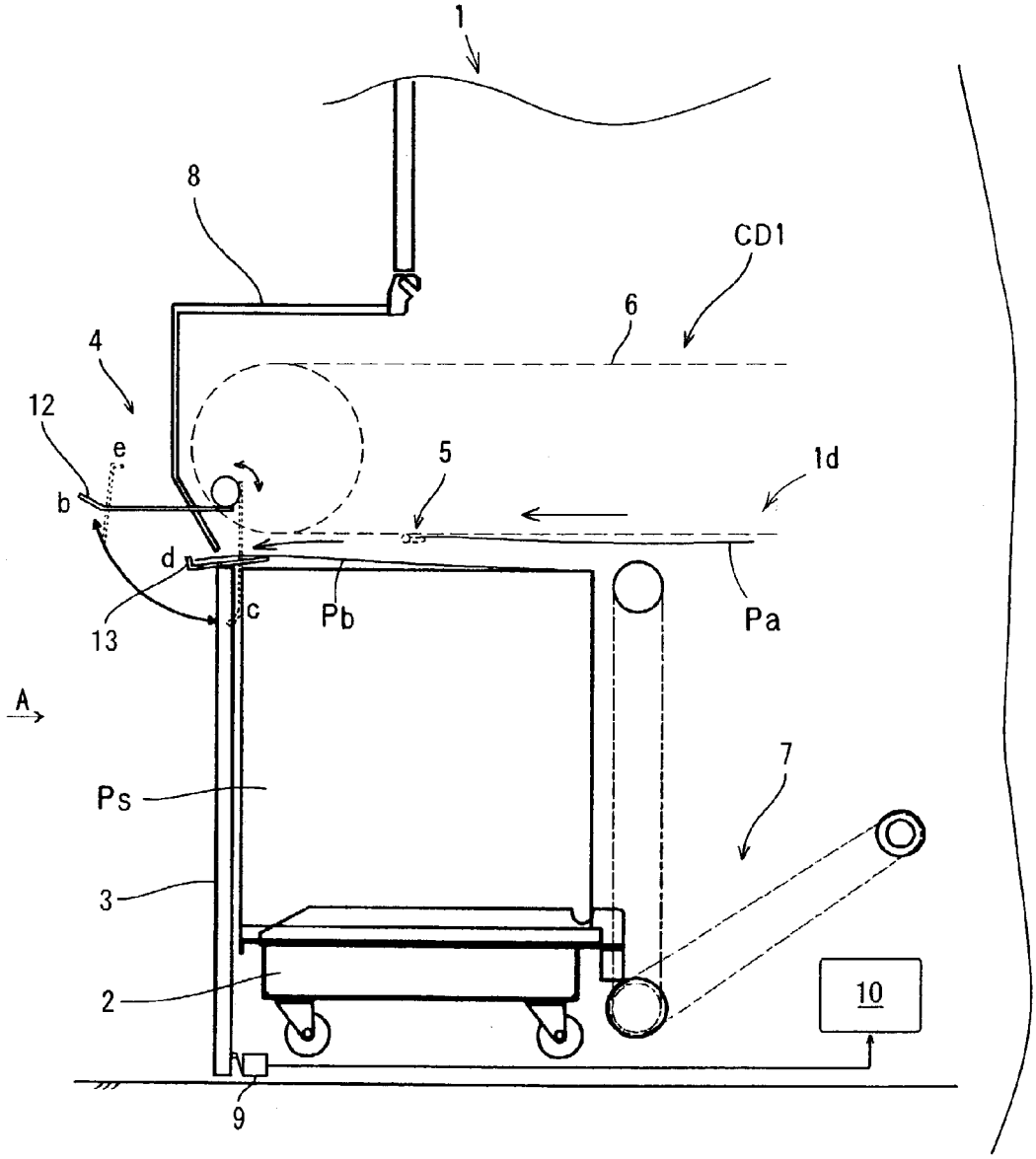
FIG. 1 is a sectional side view of a delivery section and its surrounding parts in a sheet-fed printing apparatus according to a first preferred embodiment of the present invention.

A first preferred embodiment according to the present invention will now be described with reference to the drawings. FIG. 1 is a sectional side view showing an example of a delivery section 1*d* of a sheet-fed printing apparatus 1 according to the present invention. As illustrated in FIG. 1, the delivery section 1*d* of the first preferred embodiment comprises a delivery table 2 for receiving successive printed sheets Pa transported theretoward by a chain delivery CD 1 serving as a transport element, to form a stack of printed sheets thereon; a delivery section cover 3 for covering the delivery section 1*d*; and a sheet-trapping mechanism 4 for positioning the leading edge of a discharged printed sheet Pa.

The chain delivery CD1 is a known mechanism, and includes grippers 5 (only one of which is shown in FIG. 1) each for gripping the leading edge of the printed sheet Pa, and a chain 6 for carrying the grippers 5 attached thereto around. A gripper 5 gripping the printed sheet Pa is caused to make an opening movement by the action of a cam mechanism not shown when it is over the delivery table 2, thereby releasing (or dropping) the printed sheet Pa onto the delivery table 2 or onto stacked printed sheets Ps piled on the delivery table 2.

The delivery table 2 is a table on casters for placing the stacked printed sheets Ps thereon, and is movable up and down by a vertical movement mechanism 7. Specifically, the delivery table 2 is in a raised position near the gripper 5 at the commencement of printing, and is moved downwardly each time a new printed plate Pa is released and stacked, thereby to provide a constantly fixed distance that the printed sheets Pa fall from the grippers 5. In some cases, the delivery table 2 is provided with a centering mechanism not shown for aligning the stacked printed sheets Ps in a direction perpendicular to the plane of the figure.

The delivery section cover 3 is a shielding member capable of opening and closing for covering the delivery section 1*d*. In conjunction with a fixed cover 8 provided also as a shielding member, the delivery section cover 3 prevents an operator from gaining access to the inside of the sheet-fed printing apparatus 1 during a printing operation. Specifically, a safety switch 9 for detecting whether the delivery section cover 3 is open or closed is provided in the closed position of the delivery section cover 3. The operation of the safety switch 9 is always monitored by a controller 10 for controlling the operation of the sheet-fed printing apparatus 1. When the safety switch 9 detects that the delivery section cover 3 is open, the controller 10 performs the process of, for example, stopping the operation of the sheet-fed printing apparatus 1 or actuating an alarm for alerting the operator and the like to a danger.

Figure 2:
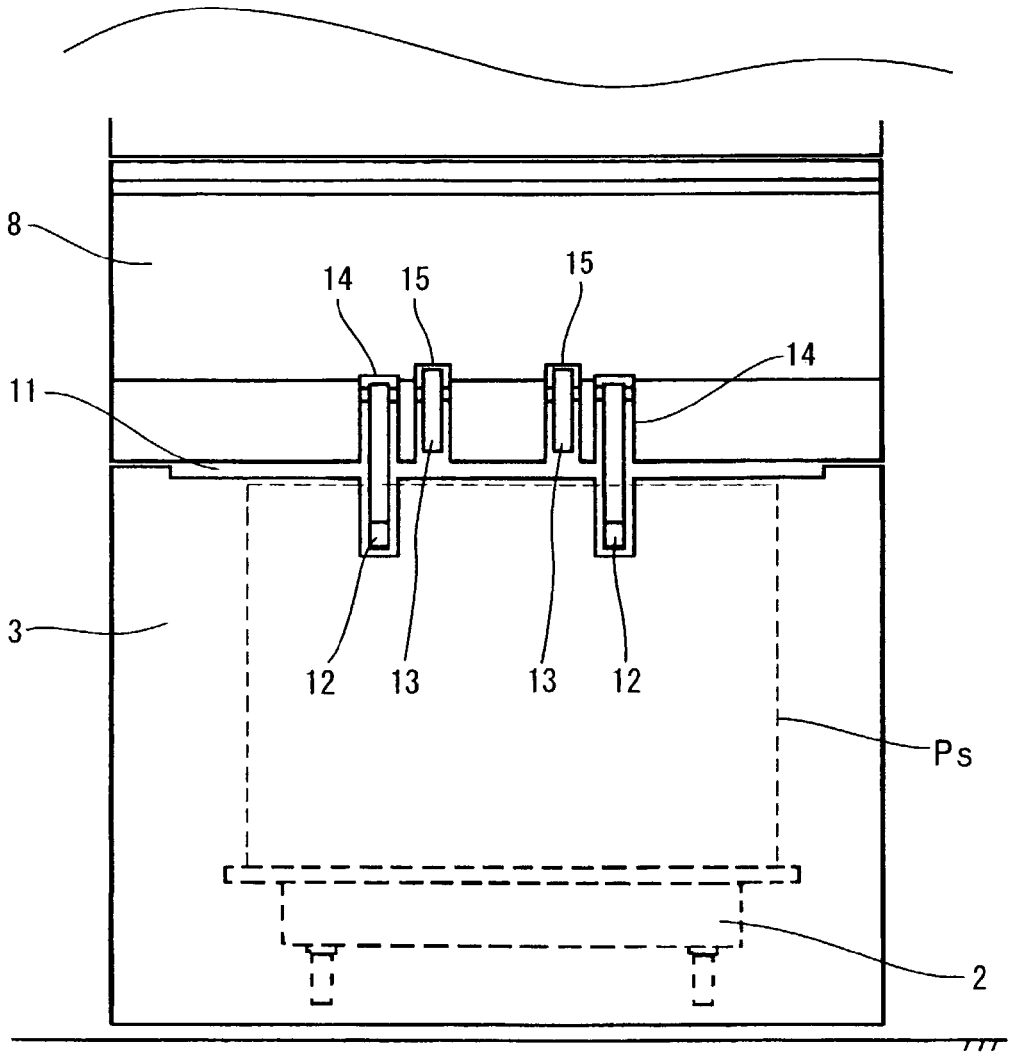
FIG. 2 is a front view of the delivery section.

FIG. 2 is a view of the delivery section cover 3 as seen in the direction of the arrow A of FIG. 1. As shown in FIG. 2, a horizontally extending slit opening 11 is cut in an upper portion of the delivery section cover 3. The opening 11 is located at a destination to which the gripper 5 drops the printed sheet Pa, and is sized to allow the printed sheet Pa to pass through. In this preferred embodiment, the opening 11 is positioned so that the printed sheet Pa discharged from the gripper 5 travels a predetermined flight path and then passes through the opening 11. A pair of vertically extending openings 14 and a pair of vertically extending openings 15 which allow a pair of first sheet-trapping elements 12 and a pair of second sheet-trapping elements 13, respectively, to be described later to pass through are formed between the delivery section cover 3 and the fixed cover 8. Preferably, the openings 11, 14 and 15 are sized and shaped to prevent the operator from inserting his/her hand therethrough and gaining access to movable parts in the sheet-fed printing apparatus 1.

Figure 3:
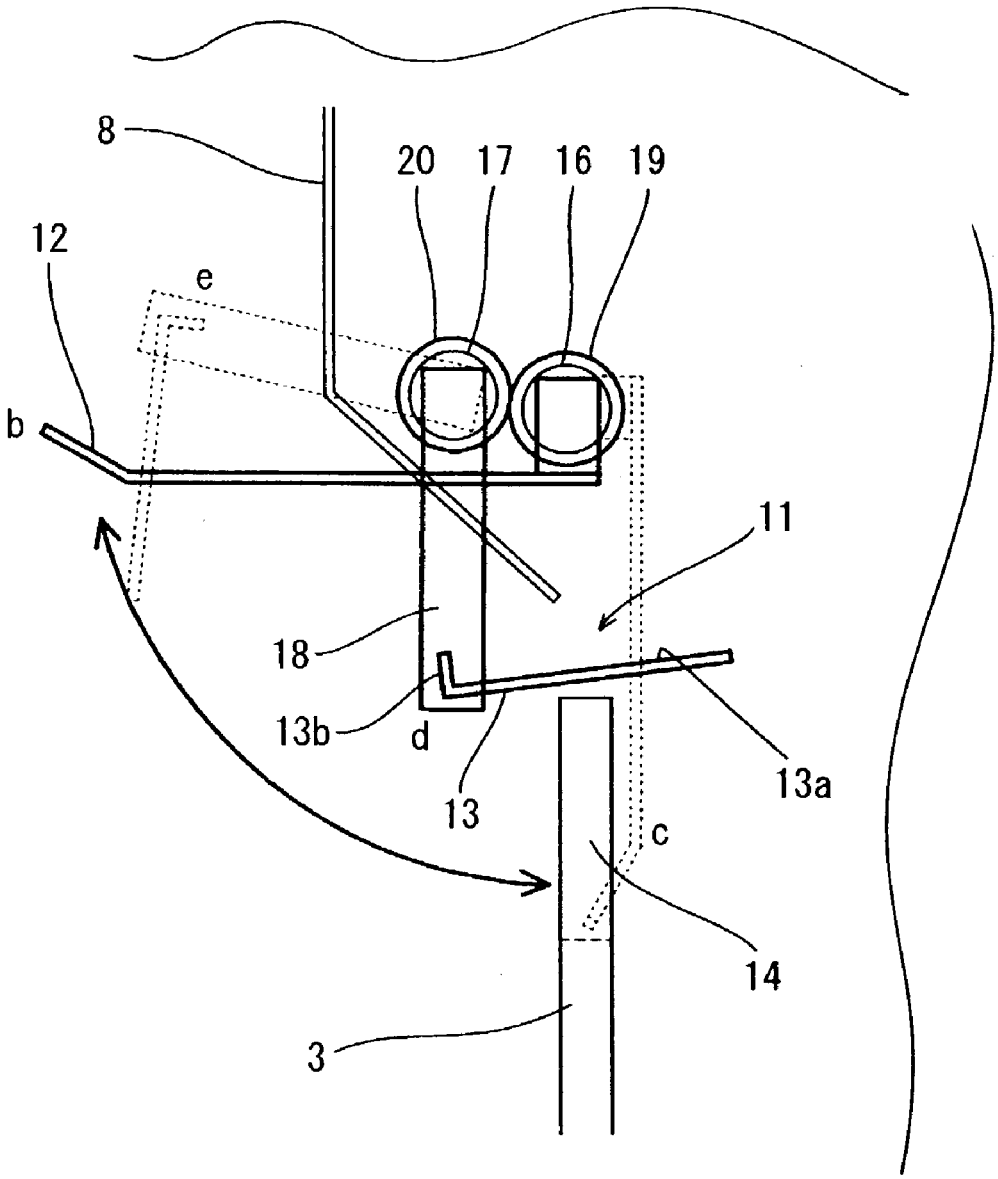
FIG. 3 is a view showing the construction of first and second sheet-trapping elements.

The sheet-trapping mechanism 4 comprises the pair of first sheet-trapping elements 12 pivotable between an open position b indicated by the solid lines in FIGS. 1 and 3 and a closed position c indicated by the dotted lines, and the pair of second sheet-trapping elements 13 pivotable between a closed position d indicated by the solid lines in FIGS. 1 and 3 and an open position e indicated by the dotted lines.

The construction of the first and second sheet-trapping elements 12 and 13 will be described with reference to FIG. 3. Each of the first sheet-trapping elements 12 is an elongated plate-like member having a slightly bent forward end. The first sheet-trapping elements 12 are fixed to a rotary shaft 16 rotatably supported by a frame of the sheet-fed printing apparatus 1, and are manually pivotable in a direction indicated by the double-headed arrow of FIG. 3. The pair of sheet-trapping elements 12 are arranged in a direction parallel to the leading edge of the printed sheet Pa, as shown in FIG. 2, and are integrally fixed to the rotary shaft 16.

Each of the second sheet-trapping elements 13 is an L-shaped plate-like member, attached to a mounting metal piece 18, supported by a rotary shaft 17. The pair of sheet-trapping elements 13 are arranged in the direction parallel to the leading edge of the printed sheet Pa, as shown in FIG. 2, and are integrally fixed to the rotary shaft 17.

Gears 19 and 20 are provided in coaxial relation with the rotary shafts 16 and 17, respectively, and are in interlocking and meshing engagement with each other. Thus, the pivotal movement of the first sheet-trapping elements 12 drives the second sheet-trapping elements 13 to pivot in the opposite direction. More specifically, when the first sheet-trapping elements 12 are in the open position b, the second sheet-trapping elements 13 are in the closed position d. Conversely, when the first sheet-trapping elements 12 are in the closed position c, the second sheet-trapping elements 13 are in the open position e.

The closed position c of the first sheet-trapping elements 12 is inward of the sheet-fed printing apparatus 1 from the delivery section cover 3. The first sheet-trapping elements 12, when in the closed position c, can block the printed sheet Pa from passing through the opening 11. The closed position d of the second sheet-trapping elements 13 is substantially level with the bottom of the opening 11. When the second sheet-trapping elements 13 are in the closed position d, longitudinal flat portions 13*a* of the respective second sheet-trapping elements 13 project out over the stacked printed sheets Ps. The longitudinal flat portions 13*a* of the respective second sheet-trapping elements 13 in the closed position d are situated to guide the back surface of the printed sheet Pa to be discharged next for ease of the passage of the printed sheet Pa through the opening 11. Bends 13*b* of the respective second sheet-trapping elements 13 are upright and are situated outside the delivery section cover 3 to function to stop the leading edge of the printed sheet Pa tending to pass through the opening 11. Such an arrangement aligns the leading edges of printed sheets Pa successively discharged and then projecting outwardly of the opening 11, and blocks the printed sheets Pa from passing through the opening 11.

In the above-mentioned construction of the sheet-trapping mechanism 4, when the first sheet-trapping elements 12 are maintained in the closed position c, discharged printed sheets Pa successively collide against the first sheet-trapping elements 12 and are stacked on the delivery table 2. When an operator who wants to obtain printed samples manually opens the first sheet-trapping elements 12 to the open position b, the second sheet-trapping elements 13 pivot to the closed position d in synchronism with the first sheet-trapping elements 12. In this state, the discharged printed sheets Pa pass through the opening 11, but the leading edges of the printed sheets Pa are stopped by the bends 13*b* of the respective second sheet-trapping elements 13. In other words, the printed sheets Pa are carried and held by the second sheet-trapping elements 13, with the leading edges of the printed sheets Pa projecting outwardly of the delivery section cover 3. Accessible printed sheets Pb shown in FIG. 1 are in such a position. The operator takes a required number of printed samples out of the plurality of accessible printed sheets Pb carried on the second sheet-trapping elements 13, thereby to obtain the printed samples while the delivery section cover 3 is closed. After taking out the printed samples carried on the second sheet-trapping elements 13, the operator may return the first sheet-trapping elements 12 to the closed position c.

The first preferred embodiment is adapted so that the printed sheet Pa released from the gripper 5 is discharged directly through the opening 11 to the outside of the sheet-fed printing apparatus 1. This eliminates the need to provide an additional transport driving source for discharging the printed sheet Pa.

Figure 4:
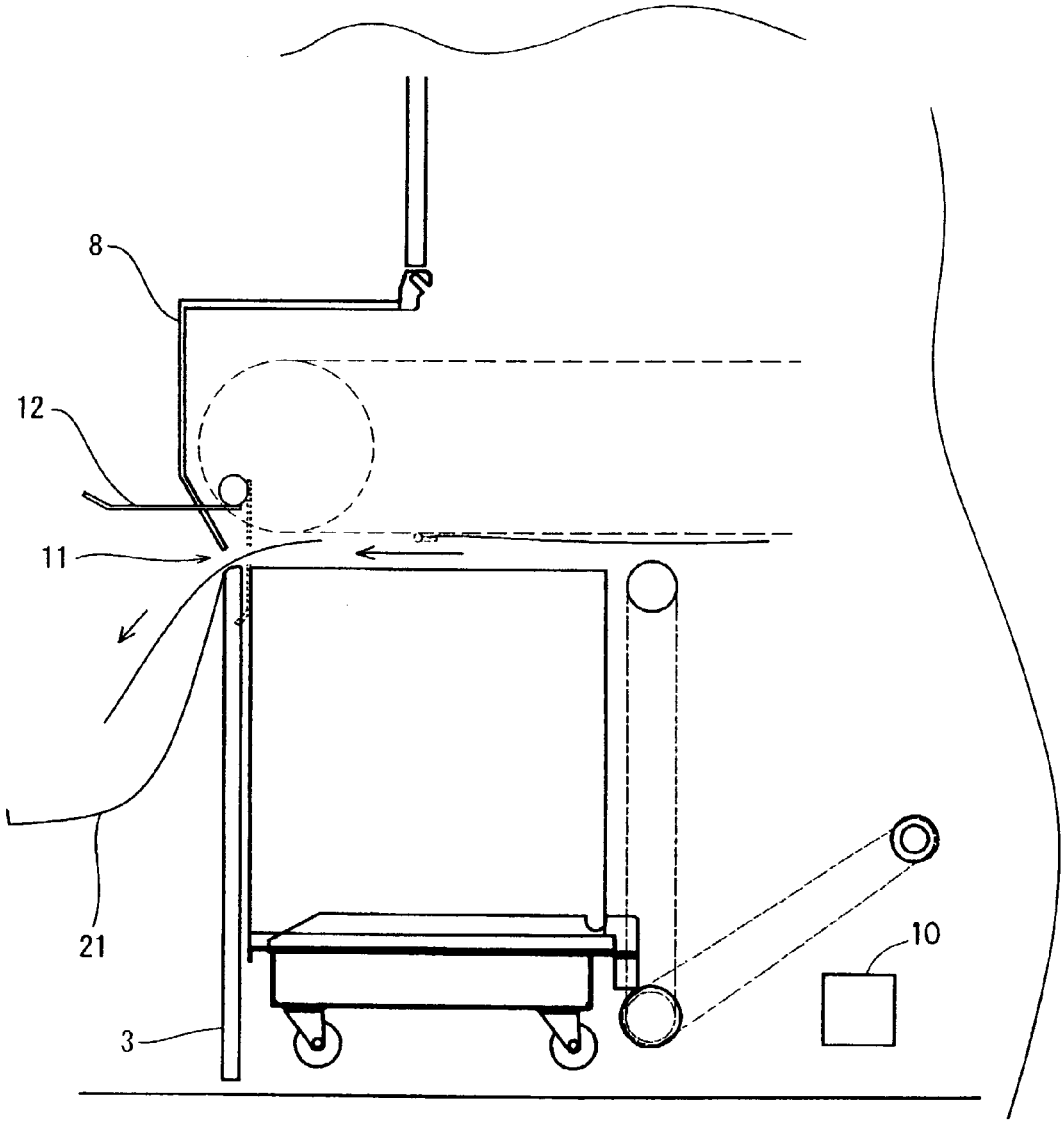
FIG. 4 is a sectional side view of the delivery section according to a modification of the first preferred embodiment.

Modifications of First Preferred Embodiment (1) In the first preferred embodiment described above, the accessible printed sheets Pb which can become the printed samples are carried and held by the second sheet-trapping elements 13. However, the second sheet-trapping elements 13 may be dispensed with. FIG. 4 shows a discharge tray 21 provided in place of the second sheet-trapping elements 13, as an example. The discharge tray 21 is a member mounted to the outer surface of the delivery section cover 3 and having a slide-down surface extending gently downwardly from the bottom of the opening 11 for receiving the accessible printed sheets Pb. In this modification, when the first sheet-trapping elements 12 are opened, the printed sheets Pa successively discharged out of the opening 11 are carried on the discharge tray 21 as the accessible printed sheets Pb completely slid down onto the discharge tray 21 or completely discharged outwardly of the sheet-fed printing apparatus 1. A roller for guiding the back surfaces of the printed sheets Pa may be provided near the bottom of the opening 11 so that the printed sheets Pa completely slide down along the slide-down surface of the discharge tray 21 without making a stop at some midpoint. This roller may be adapted to always rotate, as required.

(2) The first and second sheet-trapping elements 12 and 13 are manually opened and closed in the first preferred embodiment, but may be opened and closed by a driving element such as a motor. In this case, the controller 10 preferably monitors the feed timing of the printed sheets Pa to cause the opening movement of the first sheet-trapping elements 12 to be timed with the feed of the printed sheets Pa. This allows the first sheet-trapping elements 12 to open in proper timed relation if the printing speed is high.

(3) In the first preferred embodiment, the opening 11 is cut in the upper portion of the delivery section cover 3 which is opened and closed. However, an opening may be formed in an intermediate portion of the delivery section cover 3 or formed in the fixed cover 8. That is, an opening may be provided which permits the printed sheets Pa to pass through the cover placed forward of the falling path of the printed sheets Pa.

(4) So far as the scheme of taking out the printed samples is capable of taking the entire printed samples out of the sheet-fed printing apparatus 1 as described in Modification (1), this scheme may be combined with the scheme of Modification (2) to automate the taking out of the printed samples. For example, an input element is used to previously determine a required sampling interval and the required number of printed samples, and the operation of the first sheet-trapping elements 12 is controlled based on the number of printed sheets counted by a printed sheet counter. This allows the first sheet-trapping elements 12 to be held in the open position at the determined sampling intervals and for a length of time required to take out printed samples the number of which is previously determined, thereby achieving the automation of the taking out of a desired number of printed samples.

(5) In the first preferred embodiment, while the first sheet-trapping elements 12 are open, the printed sheet Pa is always discharged as the accessible printed sheet Pb to the second sheet-trapping elements 13. Thus, a plurality of printed sheets Pa are discharged in some cases while the first sheet-trapping elements 12 are open during high-speed printing. If only a single printed sample is needed, a mechanism may be provided for stopping discharging subsequent printed sheets Pa to the second sheet-trapping elements 13.

Figure 5:
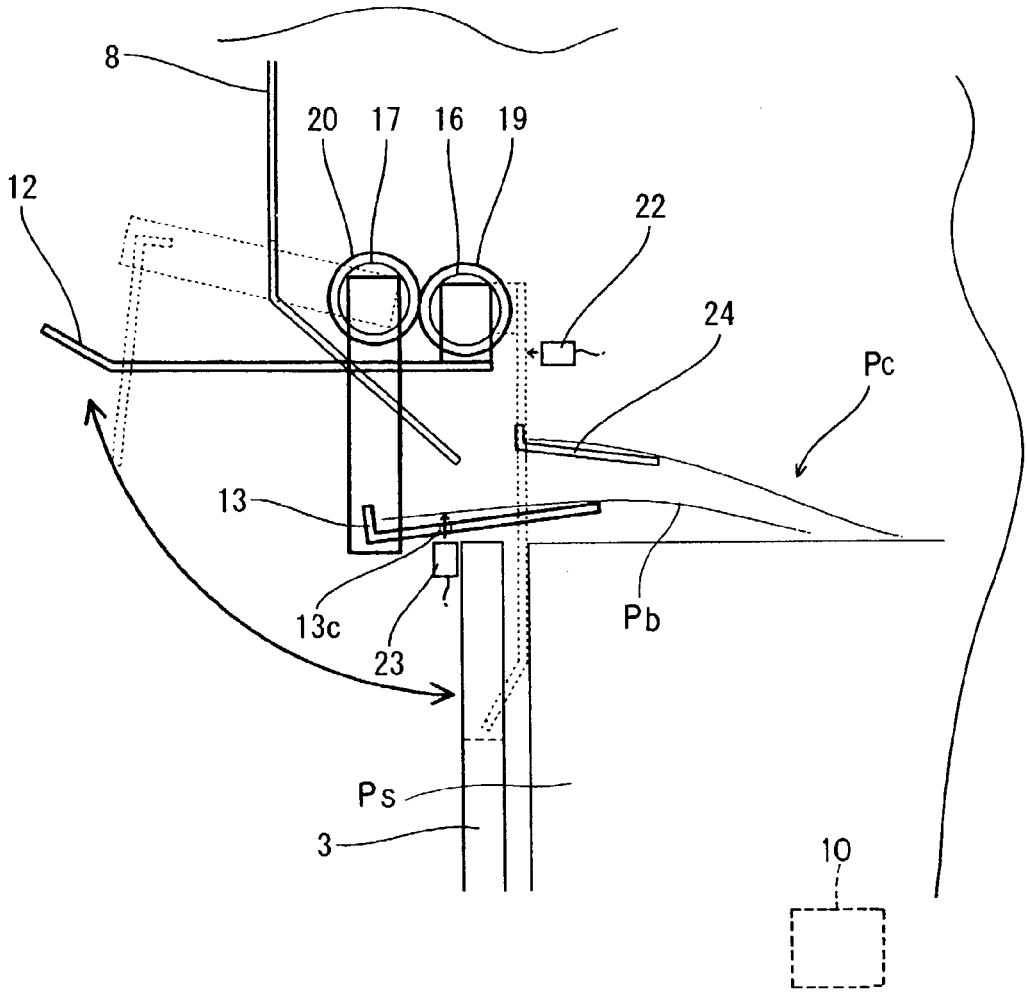
FIG. 5 is a view showing the construction of the first and second sheet-trapping elements and their surrounding parts according to another modification of the first preferred embodiment.

FIG. 5 shows such a modification which comprises a sensor 22 for detecting whether the first sheet-trapping elements 12 are open or closed, a sensor 23 for detecting whether or not a printed sheet Pa is discharged onto the second sheet-trapping elements 13, and a temporary sheet-receiving element 24 insertable into a predetermined operative position (shown in FIG. 5).

In this modification, when the first sheet-trapping elements 12 are opened and a printed sheet Pa is discharged as an accessible printed sheet Pb onto the second sheet-trapping elements 13, the sensor 23 detects the presence of the accessible printed sheet Pb. The sensor 23 is, for example, an optical sensor capable of detecting the accessible printed sheet Pb through a through hole 13*c* formed in the second sheet-trapping elements 13.

When the sensor 23 detects the accessible printed sheet Pb, the controller 10 causes a predetermined driving element to insert the temporary sheet-receiving element 24 from an inoperative position not shown into the operative position. For example, if the inoperative position is outward of a printed sheet discharge path in a direction perpendicular to the plane of the figure, the temporary sheet-receiving element 24 may be moved in the direction perpendicular to the plane of the figure by a slide movement mechanism such as a solenoid to enter the printed sheet discharge path.

After only the single accessible printed sheet Pb is discharged onto the second sheet-trapping elements 13, a printed sheet Pa is carried as a temporarily carried printed sheet Pc on the temporary sheet-receiving element 24 even if the first sheet-trapping elements 12 are open. When the sensor 22 detects that the first sheet-trapping elements 12 are closed after the printed sample is removed from the second sheet-trapping elements 13, the controller 10 returns the temporary sheet-receiving element 24 to its inoperative position. At the same time, the temporarily carried printed sheet Pc on the temporary sheet-receiving element 24 is transferred onto the delivery table 2. This modification ensures the taking out of the single printed sample even at a high printing speed.

Second Preferred Embodiment

Figure 6:
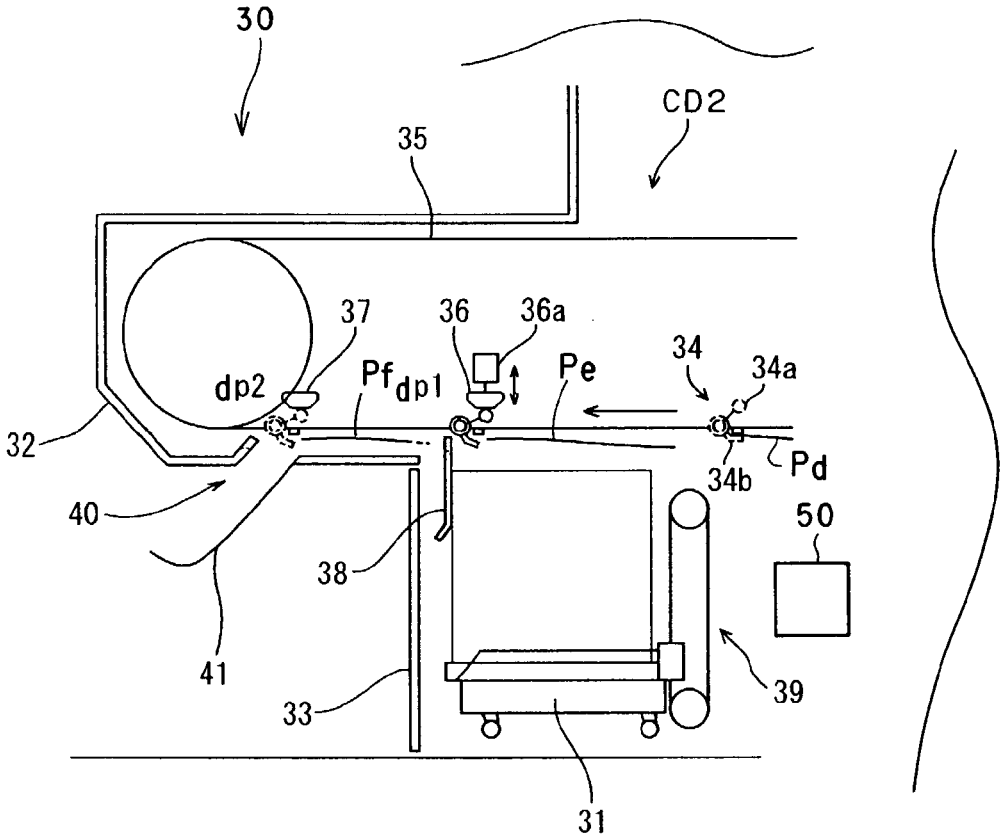
FIG. 6 is a sectional side view of the delivery section according to a second preferred embodiment of the present invention.
Figure 7:
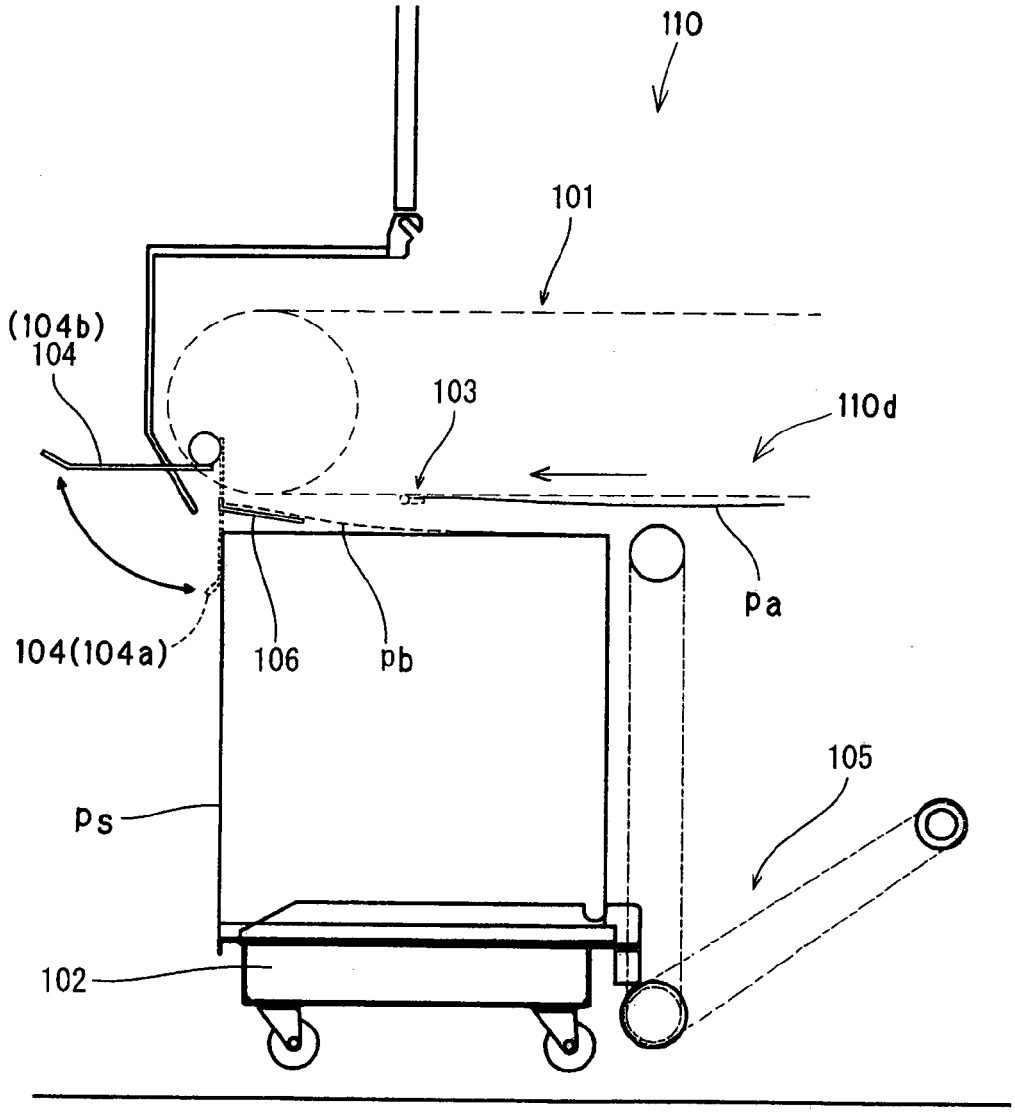
F I G . 7 (PRIOR ART)
FIG. 7 is a sectional side view of a delivery section of a conventional sheet-fed printing apparatus.

A second preferred embodiment according to the present invention will now be described with reference to FIG. 6. FIG. 6 is a sectional side view showing a delivery section 30*d* of a sheet-fed printing apparatus 30 according to the second preferred embodiment.

As illustrated in FIG. 6, the delivery section 30*d* of the sheet-fed printing apparatus 30 comprises a chain delivery CD2 for transporting printed sheets; a delivery table 31 for receiving successively discharged printed sheets to form a stack thereon; and covers 32 and 33 for covering said chain delivery CD2 and the delivery table 31.

The chain delivery CD2 includes grippers 34 each for gripping a printed sheet Pd, and a chain 35 for carrying the grippers 34 attached thereto around. Each of the grippers 34 includes a cam follower 34*a*, and a gripper finger 34*b* operated to open and close by the cam follower 34*a*. The cam follower 34*a* is urged by a spring not shown in such a direction as to close the gripper finger 34*b*.

In the path of movement of the grippers 34, a movable cam 36 is provided at a first discharge point dp1, and a fixed cam 37 is provided at a second discharge point dp2 downstream of the first discharge point dp1. Each of the movable cam 36 and the fixed cam 37 is provided with a cam plate. When each of the grippers 34 passes by the movable cam 36 or the fixed cam 37, the cam follower 34*a* collides against the movable cam 36 or the fixed cam 37 to open the gripper finger 34*b*, whereby the printed sheet Pd is dropped and discharged. The movable cam 36 is selectively movable between a lowered position in which the movable cam 36 collides against the cam follower 34*a* and a raised position clear of the cam follower 34*a*, and is controlled by a controller 50. The movable cam 36 is driven to move up and down, for example, by a solenoid 36*a*, but may be so driven by a hand-operated lever. The fixed cam 37 is in a fixed location so as to constantly come in contact with the cam follower 34*a*.

The delivery table 31 is provided under the first discharge point dp1 and is disposed to receive a printed sheet Pe released by the gripper 34. The delivery table 31 places thereon successively discharged printed sheets Pe as the stacked printed sheets Ps aligned by a sheet-trapping element 38. The delivery table 31 is movable up and down by a vertical movement mechanism 39 to provide a constantly fixed distance that the printed sheets Pe fall from the grippers 34 onto the delivery table 31 or the stacked printed sheets Ps.

The covers 32 and 33 cover the chain delivery CD2 and the delivery table 31. The cover 33 is openable and closable so that the stacked printed sheets Ps on the delivery table 31 are taken out after the printing operation. The cover 32 is formed with an opening 40 near the second discharge point dp2. A printed sheet Pf discharged at the second discharge point dp2 passes through the opening 40 and is received in a tray 41.

In this preferred embodiment, the movable cam 36 is normally in the lowered position, and causes the gripper 34 to open at the first discharge point dp1. Thus, the discharged printed sheets Pe are successively stacked on the delivery table 31. When an operator obtains a printed sample, the movable cam 36 is withdrawn to the raised position. This precludes the gripper finger 34*b* from making the opening movement at the first discharge point dp1. Hence, the printed sheet Pd is not discharged at the first discharge point dp but is discharged at the second discharge point dp2. The printed sheet Pf discharged at the second discharge point dp2 passes through the opening 40 and is received as the printed sample into the tray 41.

There is no need to open and close the covers 32 and 33 to obtain a printed sample also in the second preferred embodiment. Therefore, the operator can arbitrarily take out the printed sample during the printing operation even if the covers 32 and 33 are provided with an interlock for safety.

Preferably, the movement of the movable cam 36 is timed in synchronism with the printing speed. For example, a sampling interval at which the printed sample is taken out and the required number of printed samples are previously determined, and the controller 50 may control the vertical movement of the movable cam 36 in accordance with the determined conditions. This achieves the automation of the taking out of the printed sample.

In the second preferred embodiment, the delivery table 31 is disposed just under the first discharge point dp1. However, the delivery table 31 may be disposed just under the second discharge point dp2, whereas the opening 40 for taking out the printed sample therethrough be disposed at the first discharge point dp1. In this case, the movable cam 36 is normally in the raised or inoperative position, and may be moved to the lowered position only when the operator wants to obtain a printed sample.

While the invention has been described in detail, the foregoing description is in all aspects illustrative and not restrictive. It is understood that numerous other modifications and variations can be devised without departing from the scope of the invention.

What is claimed is:

1. A sheet-fed printing apparatus comprising:

a) a delivery section capable of receiving a stack of printed sheets;

b) a transport element for transporting a printed sheet to a release position to drop said printed sheet in said release position;

c) shielding element for shielding said delivery section and said transport element from an external environment of said sheet-fed printing apparatus, said shielding element being constituted to shield at least a side of said sheet-fed printing apparatus perpendicular to a transport direction of said printed sheet, and having an opening permitting said printed sheet dropped at said release position to pass through to an outside of said sheet-fed printing apparatus;

d) a first sheet-trapping element being constituted at said opening and movable between a closed position for closing said opening and an open position for opening said opening; and e) a second sheet-trapping clement capable of stopping the leading edge of said printed sheet to be discharged through said opening to hold said printed sheet, wherein said printed sheet is discharged to said delivery section to be stacked when said first sheet-trapping element is in said closed position, and is discharged out of said sheet-fed printing apparatus when said first sheet-trapping element is in said open position, said first sheet-trapping element and said second sheet-trapping element are in interlocking and meshing engagement with each other, and are individually pivotable; and said second sheet-trapping element is in an inoperative position when said first sheet-trapping element is in said closed position, and is in an operative position when said first sheet-trapping element is in said open position.

2. The sheet-fed printing apparatus according to claim 1, wherein said shielding element comprises a first shielding element openable and closable for shielding said delivery section from the external environment of said sheet-fed printing apparatus, and a second shielding element for shielding at least said transport element from the external environment of said sheet-fed printing apparatus; and at least the portion of said printed sheet is discharged out of said sheet-fed printing apparatus through said opening when said first shielding element is closed.

3. The sheet-fed printing apparatus according to claim 2, further comprising:

an opening and closing detection element for detecting whether said first shielding element is open or closed; and a controller for judging whether or not to operate said sheet-fed printing apparatus in response to a signal from said opening and closing detection element, wherein said sheet-fed printing apparatus stops operating when said first shielding element is open.

4. The sheet-fed printing apparatus according to claim 2, wherein said opening is formed between said first shielding element and said second shielding element, and includes a first opening seized to permit said printed sheet to pass through, the longitudinal direction of said first opening being horizontal, and a second opening, the longitudinal direction of said second opening being perpendicular to said longitudinal direction of said first opening;

said first sheet-trapping element is movable between a closed position for closing said second opening and an open position for opening said second opening; and said printed sheet is discharged to said delivery section when said first sheet-trapping element is in said closed position, and is discharged through said first opening out of said sheet-fed printing apparatus when said first sheet-trapping element is in said open position.

5. The sheet-fed printing apparatus according to claim 1, further comprising a temporary sheet-receiving element for receiving a predetermined number of printed sheets during a time interval between the holding of said predetermined number of printed sheets by said second sheet-trapping element and the returning of said first sheet-trapping element to said closed position.

6. The sheet-fed printing apparatus according to claim 5, further comprising a discharge detection element for detecting whether said predetermined number of printed sheets held by said second sheet-trapping element are present or absent, wherein said temporary sheet-receiving element operates when said discharge detection element detects the presence of said predetermined number of printed sheets.

* * * * *